US007694477B2

(12) United States Patent
Kuelker

(10) Patent No.: US 7,694,477 B2
(45) Date of Patent: Apr. 13, 2010

(54) HANGERLESS PRECAST CLADDING PANEL SYSTEM

(76) Inventor: Peter Kuelker, 4055 - 96th Avenue SE, Calgary, AB (CA) T2C 4T7

( * ) Notice: Subject to any disclaimer, the term of this patent is extended or adjusted under 35 U.S.C. 154(b) by 121 days.

(21) Appl. No.: 11/619,443

(22) Filed: Jan. 3, 2007

(65) Prior Publication Data

US 2007/0186501 A1 Aug. 16, 2007

Related U.S. Application Data

(60) Provisional application No. 60/771,854, filed on Feb. 10, 2006.

(51) Int. Cl.
*E04B 1/70* (2006.01)

(52) U.S. Cl. ..... 52/302.3; 52/520; 52/526; 52/533

(58) Field of Classification Search ..... 52/302.2, 52/520, 526, 533, 539, 541, 543, 547, 592.1, 52/302.1, 55, 1, 2, 552, 551, 302.3, 409, 52/518, 553, 521, 506.05, 747.11, 747.12, 52/747.1

See application file for complete search history.

(56) References Cited

U.S. PATENT DOCUMENTS 1,281,006 A * 10/1918 Hobson ..... 160/184
2,075,676 A * 3/1937 Toney ..... 52/466
2,126,676 A * 8/1938 Thomas ..... 52/520
2,990,651 A * 7/1961 Chalmers ..... 52/541
3,003,205 A * 10/1961 Frashour et al. ..... 52/309.3
3,943,677 A * 3/1976 Carothers ..... 52/309.4
4,015,391 A * 4/1977 Epstein et al. ..... 52/520
4,223,490 A 9/1980 Medow
4,229,916 A * 10/1980 White ..... 52/98
4,327,528 A * 5/1982 Fritz ..... 52/309.1
4,459,788 A * 7/1984 Bockwinkel et al. ..... 52/535
4,729,202 A * 3/1988 Ferland ..... 52/520
4,736,565 A * 4/1988 Bisson ..... 52/526
4,955,169 A * 9/1990 Shisko ..... 52/536
4,982,541 A * 1/1991 Winter, IV ..... 52/302.1
5,060,444 A * 10/1991 Paquette ..... 52/535

(Continued)

FOREIGN PATENT DOCUMENTS

CA 2306916 A1 5/1999

(Continued)

*Primary Examiner*—David Dunn
*Assistant Examiner*—Joshua Ihezie
(74) *Attorney, Agent, or Firm*—Donald V. Tomkins

(57) ABSTRACT

In a precast cladding panel system requiring no cast-in mounting hardware, each panel has a continuous notch along its upper edge, forming a ledge adjacent the panel's front face, and an upstand adjacent the panel's rear face. Each panel is mounted to a supporting structure using fasteners installed through openings formed in the upstand. The panels are configured such that their lower edges fit into the notches of underlying panels, with the front faces of all panels being substantially co-planar, aided by spacer means fastened to the supporting structure adjacent to the lowermost panel course. Air circulation behind the installed panel assembly is facilitated by spaced bumpers fastened to the supporting structure so as to space the panel upstands away therefrom. Alternatively, the panels may be mounted with the upstands directly against the supporting structure, with the panels having vertical air channels formed into the upstands and rear panels faces as appropriate.

13 Claims, 8 Drawing Sheets

U.S. PATENT DOCUMENTS

| | | | | |
|---|---|---|---|---|
| D347,287 | S * | 5/1994 | Mayer | D25/140 |
| 5,443,878 | A * | 8/1995 | Treloar et al. | 428/60 |
| 5,761,864 | A * | 6/1998 | Nonoshita | 52/302.3 |
| 6,318,041 | B1 * | 11/2001 | Stanley | 52/505 |
| 6,955,019 | B2 * | 10/2005 | Donlin et al. | 52/520 |
| 2004/0200185 | A1 | 10/2004 | Liddiard | |
| 2006/0185299 | A1 | 8/2006 | Poupart | |

FOREIGN PATENT DOCUMENTS

| | | |
|---|---|---|
| GB | 1014139 | 12/1965 |
| GB | 1014140 | 12/1965 |

* cited by examiner

HANGERLESS PRECAST CLADDING PANEL SYSTEM

CROSS-REFERENCE TO RELATED APPLICATIONS

This application claims the benefit, pursuant to 35 U.S.C. 119(e), of U.S. Provisional Application No. 60/771,854, filed on Feb. 10, 2006, and said provisional application is incorporated herein by reference in its entirety.

FIELD OF THE INVENTION

The present invention relates in general to precast cladding panels, and in particular to precast cladding panels that do not require hangers or other mounting hardware to be cast into the panels.

BACKGROUND OF THE INVENTION

Precast panels of various sizes and shapes are widely used as cladding on building walls, serving as components of building envelope systems intended to prevent infiltration of rain and outside air into the building. Precast cladding panels are commonly made of concrete, but may also be made with other cast materials known in the construction field. Concrete cladding panels are common on large structures such as office buildings, but they are also used on residential housing structures as an alternative to traditional cladding materials such as wood siding and brick.

Whether installed on large or small buildings, it is desirable for cladding panels to be mounted in such a way that there will be a continuous air space between the rear (i.e., inner) faces of the panels and the supporting structure, while at the same time providing reliable structural support for the panels, both to transfer the vertical weight of the panels to the supporting structure and to provide anchorage against lateral forces (such as wind) that may act on the panels.

The purpose of the air space is to provide a passage through which any water or moisture vapour that gets behind the cladding can be directed away from the building envelope before it infiltrates other parts of the building. Although caulking or other sealant materials are typically used to seal the spaces between cladding panels, the possibility of moisture infiltration behind the cladding—as a result of vapour migration, direct penetration of rainwater (due to sealant deterioration or other factors), or leakage at roof-to-wall junctures—cannot be entirely eliminated. If such moisture is not removed from the building envelope fairly promptly, it will tend to migrate further into the building, potentially causing a variety of problems that could entail costly maintenance and repairs and could detract from the building's overall durability and value. Such problems may include drywall damage due to moisture absorption, rot and mold in wooden construction components (e.g., studs and sheathing), corrosion of non-rust-resistant construction hardware, and staining on interior building finishes.

When an air space is provided behind the cladding, moisture can run downward behind the cladding to exit points such as weepholes built into the cladding system at appropriate locations. The air space also facilitates or enhances air circulation behind the cladding, helping to remove moisture vapour before it can condense inside the wall structure, and helping to dry out any wall structure components that may have become damp due to moisture infiltration.

The essential problem facing designers of cladding panel support systems is to provide hangers or brackets that can adequately support weight of the panels at a distance away from the face of the supporting structure (i.e., so as to provide the desired air space), without significantly impeding the passage of water or water vapour through the air space. In this regard, it is particularly desirable to avoid or minimize hanger-to-panel connection details where moisture might become trapped or its downward vertical flow impeded.

It is desirable for concrete cladding panels to be stackable as compactly as possible to minimizing space requirements during storage and shipping. Accordingly, it is desirable to have a precast cladding panel system that reduces or substantially eliminates the space between stacked cladding panels, thus significantly reducing storage space requirements.

For the foregoing reasons, there is a need for an improved precast cladding panel system that facilitates secure mounting of panels at a uniform distance away from a vertical supporting structure without introducing significant impediments to air flow through the air space thus created between the rear faces of the panels and the supporting structure. In addition, there is a need for a precast cladding panel system that facilitates more compact stacking and storage of panels, with the space between stacked panels reduced or eliminated. The present invention is directed to these needs.

BRIEF DESCRIPTION OF THE INVENTION

In general terms, the invention is a precast cladding panel that does not require any brackets, insets, or other mounting hardware or appurtenances to be cast into or affixed to the panel to enable the panel to be mounted on a supporting structure such as a building wall. The panel system of the present invention, in each of its embodiments, inherently provides for the creation of an air space between the rear faces of the panels and the supporting structure.

In a first aspect, the present invention is a precast panel having a front face, a rear face, an upper edge, and a lower edge, wherein:

(a) the upper edge of the panel has a continuous notch, forming:
  - a.1 a ledge extending rearward from the front face of the panel; and
  - a.2 a substantially vertical upstand adjacent to the ledge and extending vertically upward from the level of the ledge; and (b) a plurality of fastener holes extend through the upstand.

In a second aspect, the invention is a panel assembly comprising a plurality of precast panels mounted to a supporting structure, each cladding panel having a front face, a rear face, an upper edge, and a lower edge, wherein:

(a) the upper edge of each panel has a continuous notch, forming:
  - a.1 a ledge extending rearward from the front face of the panel; and
  - a.2 a substantially vertical upstand adjacent to the ledge and extending vertically upward from the level of the ledge;

(b) a plurality of fastener holes extend through the upstand;

(c) each panel is mounted to the supporting structure by means of fasteners passing through said fastener holes; and (d) the lower edge of each panel in all but the lowermost courses of the panel assembly is disposed within the notch of the below-adjacent panel or panels.

The "lowermost course" of a panel assembly will generally be understood as meaning a generally horizontal course near the base of a wall or cladding panel assembly. As used in this patent document, however, the term "lowermost course" may, as the context requires, also mean a course or portion of a course that is not at or near the base of the wall or assembly, but has no panels immediately below it (for example, panels over a window, door, or other opening).

Although the panel assembly of the present invention might most commonly be constructed in horizontal courses of rectangular panels, persons skilled in the art will readily appreciate that these particular features are not essential to the invention. The principles and concepts of the invention may also be adapted to cladding panels of different shapes, including panels that have one or more curvilinear edges, and panels that are irregularly configured so as to permit construction of panel assemblies with staggered horizontal joints.

In preferred embodiments of the panel and the panel system, the horizontal ledge of the panel slopes transversely downward toward the front face of the panel, to enhance the efficiency of drainage of moisture down the rear faces of the panels and toward the front faces of the panels in lower edges of the rear faces of the panels.

Also in preferred embodiments, the thickness of the panel at its lower edge is less than or approximately equal to the transverse width of the horizontal ledge. Accordingly, the lower edges of the panels may be disposed within the notches of below-adjacent panels so as to align the front faces of the panels on either side of a horizontal joint in the panel assembly. This detail facilitates the construction of panel assemblies in which the front faces of all panels lie in substantially the same plane, as will be commonly desirable (for example, when the panels are formed with substantially planar front faces, and it is desired for the panel assembly to provide a substantially flat finished wall surface.

In other situations, it might be desirable for aesthetic reasons to create an uneven finished wall surface by having the lower edges of some panels project beyond the front faces of below-adjacent panels. Such effects may be achieved by forming the horizontal notches with a width less than the thickness of the lower edges of the panels. Alternatively, the notch width could be approximately the same as the lower edge thickness as previously described, but the panels are installed with their lower edges shifted outward to achieve the desired projection or overhang; in such cases, suitable spacer means could be provided between panel upstands and the rear faces of above-adjacent panels.

The provision of horizontal notches along the upper edges of the cladding panels facilitates efficient and accurate installation, since the panels can rest on the horizontal ledges of below-adjacent panels while being fastened to the supporting structure. However, it would also be possible (using suitable spacers or other construction techniques) to install the panels with horizontal gaps between the ledges and the lower edges of above-adjacent panels, should that be desired for any reason (e.g., to allow for differential vertical movement, or to enhance drainage of moisture from behind the panels).

In one embodiment, the panel thickness increase at a substantially uniform rate from the lower edge up to approximately the level of the horizontal ledge. To facilitate air flow behind the panel assembly when panels of this configuration are mounted with their upper edges directly against the supporting structure, horizontally-spaced channels may be formed in the panel's rear faces, extending downward from the top of the panel's upstands. Due to the panels' tapering thickness, these channels will typically terminate at a point above the panels' lower edges. Since the panels' lower edges are held away from the face of the supporting structure, there will be airspaces of varying width behind each panel, in fluid communication with each other by virtue of the channels formed in the rear faces of the panels. In this way, the present invention provides for effective air circulation behind the panel assembly even in embodiments where the upper edges of the panels are mounted directly against the supporting structure.

In a further embodiment of the system, the panel thickness is substantially constant, up to a level below the horizontal ledge, while the rear face of the panel upstand extends down to approximately the same level, such that the upstand protrudes rearwardly from the rear face of the panel. In this embodiment, horizontally-spaced, generally vertical channels may be formed in the rear face of the upstand, for its full height, in order to provide for air circulation behind the panel assembly when the panels are mounted with their upstands directly against the supporting structure.

However, other embodiments of the invention provide for air circulation behind the panel assembly without need for air channels formed in the rear faces of the panels or upstands. In these alternative embodiments of the panel system, a plurality of upper bumpers are fastened to the supporting structure at appropriate horizontal spacings, such that the rear faces of the panel upstands will abut the upper bumpers, thus effectively spacing the rear faces away from the face of the supporting structure. Air can then freely flow behind the panel assembly, through the spaces between the upper bumpers. In this case, there is not need to provide air channels in the rear faces of the panels or upstands. However, it may be desirable, from a practical standpoint, to provide the panels with air channels so that they can be used with or without upper bumpers, depending on design requirements or preferences for given projects.

Whether the panels are mounted using upper bumpers or not, the lower edges of the panels in the lowermost course of the panel assembly will typically be spaced away from the supporting structure, using lower spacer means. This detail facilitates the installation of all panels in the assembly with their front faces uniformly aligned, without requiring specially-configured panels for the lowermost course. It also ensures that moisture can drain from behind the wall panels.

In preferred embodiments of the panel assembly, the lower spacer means comprises one or more J-shaped channel sections, each having a generally vertical inner flange, a generally horizontal lateral web extending outward from the bottom edge of the inner vertical flange, and a generally vertical outer flange extending upward from the outer edge of the lateral web. Typically, the J-channels are fastened to the face of the supporting structure (using screws or other suitable known fastening means) parallel to and slightly above the intended level of the lower edges of the lowermost course of panels, such that a lower portion of the rear faces of the lowermost panels will abut the outer flanges of the J-channels. Preferably, the lateral web of the J-channels will have a mesh, or openings in other suitable forms, to allow for passage of air and/or moisture. Ideally, the mesh or openings will be small enough to prevent insects, rodents, and/or birds from entering the space behind the panels.

In an alternative embodiment of the panel system, the lower spacer means may be in the form of lower bumpers generally similar to the upper bumpers previously described. The lower bumpers are fastened to the supporting structure at a suitable spacing, such that a lower portion of the rear faces of the lowermost panels abut the lower bumpers, which in turn will maintain the front faces of the lowermost panels in a substantially co-planar relationship (or other desired relationship) with the front faces of the upper panels in the assembly.

In all of the embodiments described above, the centre of gravity of the panels will be in a position such that the lower edges of the panel will inherently tend to move toward the supporting structure to which they are being mounted. This is a desirable tendency since it helps to maintain the lower panels edges within the notches of the panels below or (as the case may be) against the lower spacer means. This desirable tendency is supplemented for panel embodiments having a tapering thickness (such that the rear face of the upstand is tapered or bevelled), since in these cases the installation of the fasteners mounting the panels to the supporting structure will tend to impart a rotational moment urging the lower panels edges toward the supporting structure. A similar effect may be provided for when using panels having substantially uniform thickness and rearwardly-protruding upstands, by bevelling the rear faces of the upstands.

BRIEF DESCRIPTION OF THE DRAWINGS

Embodiments of the invention will now be described with reference to the accompanying figures, in which numerical references denote like parts, and in which.

DETAILED DESCRIPTION OF THE PREFERRED EMBODIMENT

Figure 1:
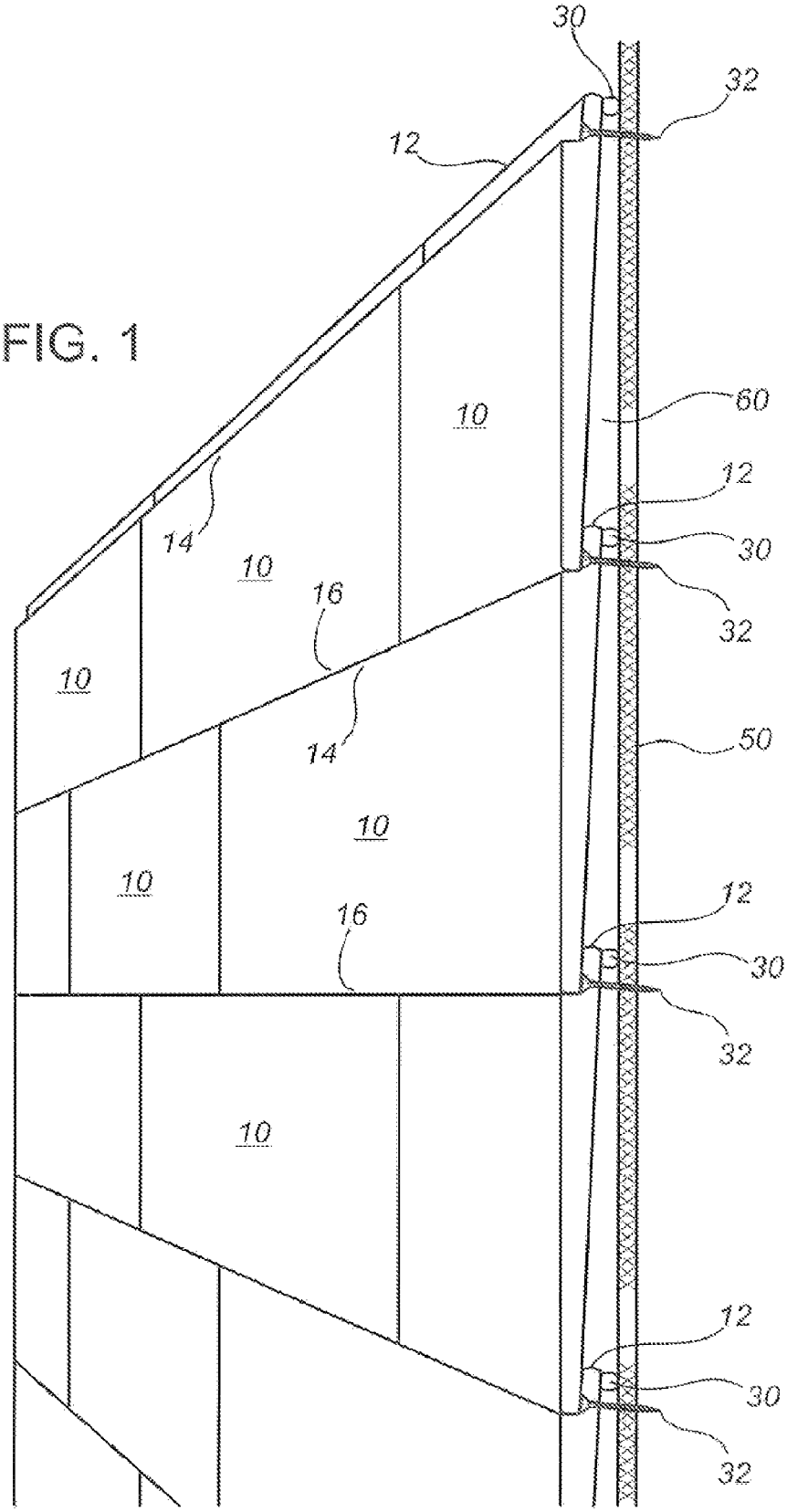
FIG. 1 is a perspective view of a mounted assembly of cladding panels in accordance with a first embodiment of the invention.
Figure 2:
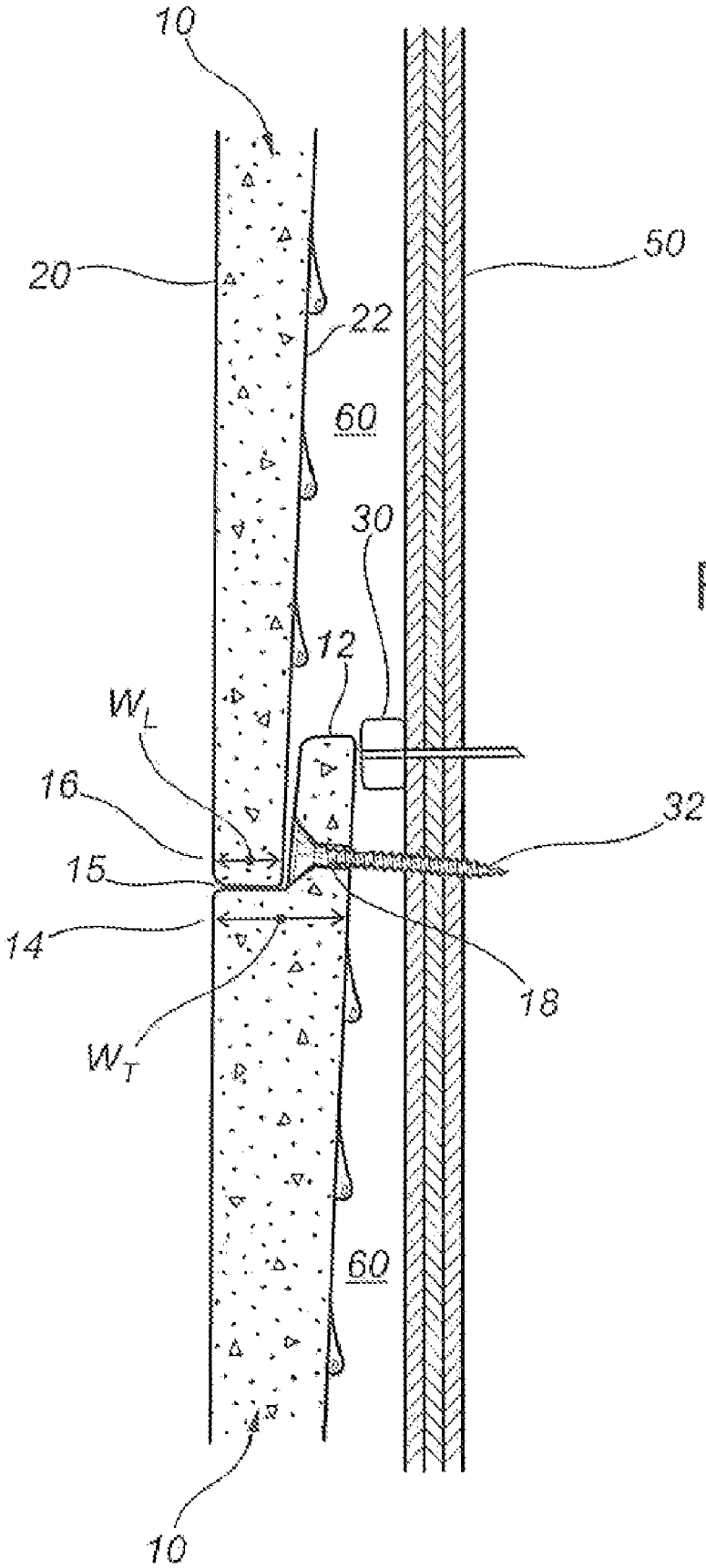
FIG. 2 is cross-section through a typical horizontal joint between cladding panels in the assembly shown in FIG. 1.

FIG. 1 illustrates a mounted assembly of cladding panels 10 in accordance with a preferred embodiment of the invention, and FIG. 2 illustrates a typical horizontal joint between mounted panels 10. The panels 10 are shown as being rectangular in shape, but other shapes are also possible without departing from the concept of the invention. Each panel 10 has a front face 20 and rear face 22. In the embodiment shown in FIGS. 1 and 2, the thickness of panel 10 tapers from a top thickness $W_T$ at upper edge 14 of panel 10 to a bottom thickness $W_L$ (which is less than top thickness $W_T$) at lower edge 16 of panel 10. Panel 10 is formed with a horizontal notch so as to form a continuous upstand 12 along upper edge 14. Upstand 12 is inset from front face 20 such that a continuous ledge 15 is formed between upstand 12 and upper edge 14. Ledge 15 is preferably formed such that when panel 10 is mounted to a support structure 50, with front face 20 in a substantially vertical orientation, ledge 15 will slope toward front face 20 to facilitate drainage of condensation or other moisture that might run down rear face 22 of the panel 10 above.

Upstand 12 has a plurality of spaced fastener holes 18, preferably close to the juncture between upstand 12 and the ledge 15 as shown in FIG. 2, for receiving fasteners 32, which preferably will be threaded fasteners (e.g., wood screws, self-tapping screws, or lag screws as may be appropriate to suit the particular type of supporting structure 50 to which panel 10 is to be mounted), or, alternatively, driven fasteners such as nails or spikes. Fasteners 32 will preferably be of galvanized or stainless steel to prevent or inhibit corrosion. Fastener holes 18 are preferably countersunk, as shown in FIG. 2, to accommodate flat-head screws. Fastener holes 18 may be formed in any suitable fashion, and may in fact be formed after panels 10 have cured (e.g., by drilling). Preferably, however, fastener holes 18 will be formed during the casting of panels 10 by means of suitably shaped rubber inserts (such as pieces of tubular rubber) bonded to the panel forms. It has been found that such inserts, due in large part to their flexibility, do not hamper the removal or stripping of cured panels 10 from the forms.

As shown in FIGS. 1 and 2, panels 10 may be mounted to support structure 50 by first fastening a plurality of upper bumpers 30 to support structure 50 in horizontal rows corresponding to the final positions of upstands 12. Upper bumpers 30 may be made of any reasonably durable material but in preferred embodiments will be made of a firm but resilient material such a rubber, neoprene, or other similar synthetic material. Upper bumpers 30 may be fastened to support structure 50 by any suitable known means, such as nails or screws, which will preferably be of galvanized or stainless steel to prevent or inhibit corrosion.

Figure 2A:
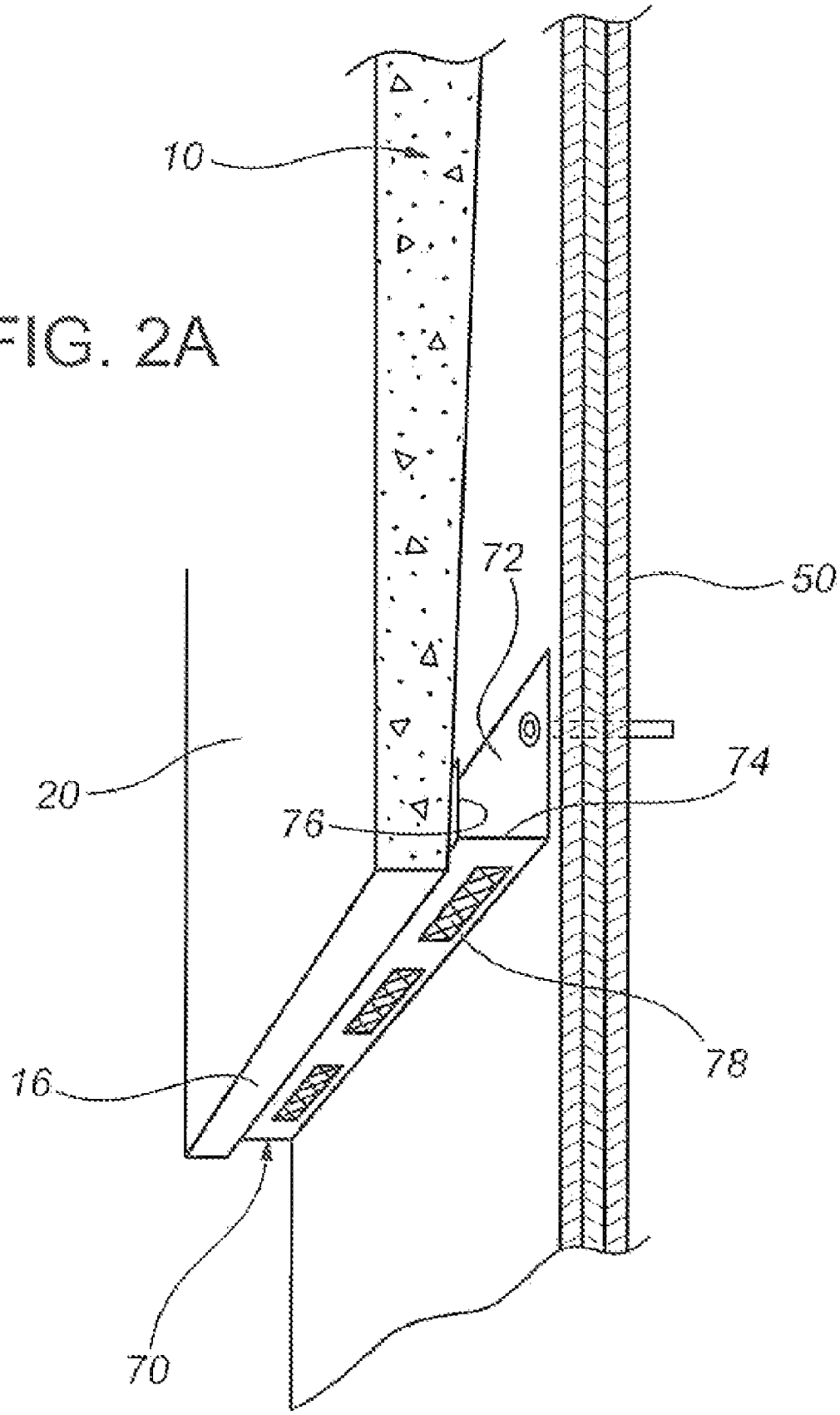
FIG. 2A is a cross-section through the lowermost course of panels in the assembly shown in FIG. 1.

It will typically be desirable or necessary to ensure that the front faces of all panels in a finished panel assembly are aligned with each other. For this purpose, lower spacer means will preferably be provided to maintain the lower edges of the panels in the lowermost panel courses at a desired spacing away from the face of the supporting structure. As shown in FIG. 2A, the lower spacer means may take the form of one or more J-shaped channel sections 70, each having a generally vertical inner flange 72, a generally horizontal lateral web 74 extending outward from the bottom edge of inner flange 72, and a generally vertical outer flange 76 extending upward from the outer edge of lateral web 74. Typically, J-channels 70 are fastened to supporting structure 50 (using screws or other suitable known fastening means) parallel to and slightly above the intended level of lower edges 16 of the lowermost course of panels 10, such that rear faces 22 of the lowermost panels will abut outer flanges 76 of J-channels 70. Preferably, lateral web 72 of J-channels 70 will have a mesh 78, or openings in other suitable forms, to allow for passage of air and/or moisture. Ideally, the mesh 78 or openings will be small enough to prevent insects, rodents, and/or birds from entering the space behind panels 10.

As discussed further on in this specification, lower edges 16 of panels 10 will generally tend to rotate toward supporting structure 50 when fastened thereto, due to gravity-induced moment and, for certain panel configurations, additional moment induced by the installation of fasteners 32. Accordingly, lower edges 16 of panels 10 in lowermost panel courses will typically have a natural and desirable tendency to press against the lower spacer means. In applications where the lower spacer means comprises J-channels 70, a continuous or intermittent bead of mastic or other suitable adhesive may be applied to the outer faces of outer flanges 76 prior to installation of the lowermost panel course. Panels 10 of the lowermost panel course will be pressed into the mastic upon installation, thereby creating a positive bond between panels 10 and J-channels 70, and supplementing the effect of gravity-induced moments to prevent outward movement of lower panel edges 16 of lowermost panels 10 (e.g., due to wind-induced suction pressures acting on the panel assembly).

A similar beneficial effect may also be achieved at upper horizontal joints between panels 10 by applying mastic to the front faces of panel upstands 12, prior to installation of above-adjacent panels 10. In exterior installations in particular, it will typically be preferable for the mastic to be applied as an intermittent bead (i.e., in spaced, short beads) so as not to hamper drainage of moisture through the horizontal joints from behind the panel assembly.

As an alternative to J-channels 70, the lower spacer means may be provided in the form of lower bumpers 31 which, although not specifically illustrated in the Figures, may be substantially similar to the previously-described upper bumpers 30. Lower bumpers 31 may be fastened to support structure 50 slightly above the intended final position of lower edges 16 of the lowermost course of panels 10. The lateral width or thickness of lower bumpers 31 will typically be greater than that of upper bumpers 30 by an amount corresponding to the difference between top thickness $W_T$ and bottom thickness $W_L$, such that front faces 20 of the lowermost course of panels 10 will be substantially vertical when mounted to a vertical support structure 50.

With upper bumpers 30 and lower bumpers 31 in place on support structure 50, the lowermost course of panels 10 is mounted by positioning each panel 10 with its upstand 12 bearing against two or more upper bumpers 30 and with its lower edge 16 bearing against at least one (and preferably two or more) lower bumpers 31. Fasteners 32 are inserted through fastener holes 18 in upstands 12, and securely driven into support structure 50, thereby anchoring panels 10 in place against support structure 50 and vertically supporting panels 10 therefrom. Due to the use of upper bumpers 30 and lower bumpers 31, the mounting of panels 10 in the described manner results in the formation of an airspace 60 between rear faces 22 and support structure 50. Due to the differing thickness of upper bumpers 30 and lower bumpers 31 as previously described, front faces 20 of the lowermost course of panels 10 will be substantially vertical. Due to the tapered configuration of panels 10, the weight of panels 10 will naturally induce a moment that tends to urge lower edges 16 against their corresponding lower bumpers 31. Due to the fastener holes 18 being lower than their corresponding upper bumpers 30, the driving of fasteners 32 into support structure 50 will exert an additional moment that further acts to hold lower edges 16 of the lowermost course of panels 10 against their corresponding lower bumpers 31.

Once the lowermost course of panels 10 has been mounted, with their ledges 15 in generally horizontal alignment, the mounting of upper courses of panels 10 is straightforward. As may be appreciated from FIG. 2, upper course panels 10 may be set on the ledges 15 of the panels 10 in the course beneath them, thus automatically aligning the upper course while at the same time covering up the heads of fasteners 32 of panels 10 in the course below. Lower edges 16 of the upper course panels 10 are held in position against upstands 12 of the lower course panels 10 by the moments induced by gravity and by the fasteners 32 used to mount the upper course panels 10, in the same fashion as previously discussed in connection with the lowermost course of panels 10. The width of ledge 15 is selected to ensure that the front faces 20 of all panels 10 will be substantially vertical, and substantially flush with each other, when their lower edges 16 are positioned against the upstands 12 of the panels 10 beneath them.

As conceptually illustrated by the water droplets shown in FIG. 2, any moisture that accumulates on rear face 22 of a given panel 10 will flow down to the juncture between upstand 12 and ledge 15 of the panel 10 below, and then will be directed toward front face 20 of the lower panel 10, preferably assisted by a built-in drainage slope on ledge 15 as previously discussed. This drainage toward the front face 20 of the lower panel 10 may be further assisted by forming intermittent notches 19 at the lower edges of rear faces 22, as shown in FIGS. 6C-6F.

It sill be readily appreciated that it is unnecessary to apply caulking or mortar to the horizontal joints between panels 10, because of the way the panels overlap the panels below. Although not illustrated, alternative variants of the cladding panels of the present invention may be readily devised which also do not require caulking or mortar in vertical joints either, by forming the vertical or side edges of the panels such that they can overlap or interlock with adjacent panels (i.e., in a fashion analogous to shiplap or tongue-and-groove lumber products). This construction detail will prevent or inhibit the entry of moisture (such as from wind-driven precipitation) through the vertical joints and into the space between the cladding panels and the supporting structure. Alternatively, the same effect could be achieved by providing suitably configured flashings associated with the vertical panel joints (e.g., flashing could be installed behind the panels and extending across the vertical joints).

Figure 3:
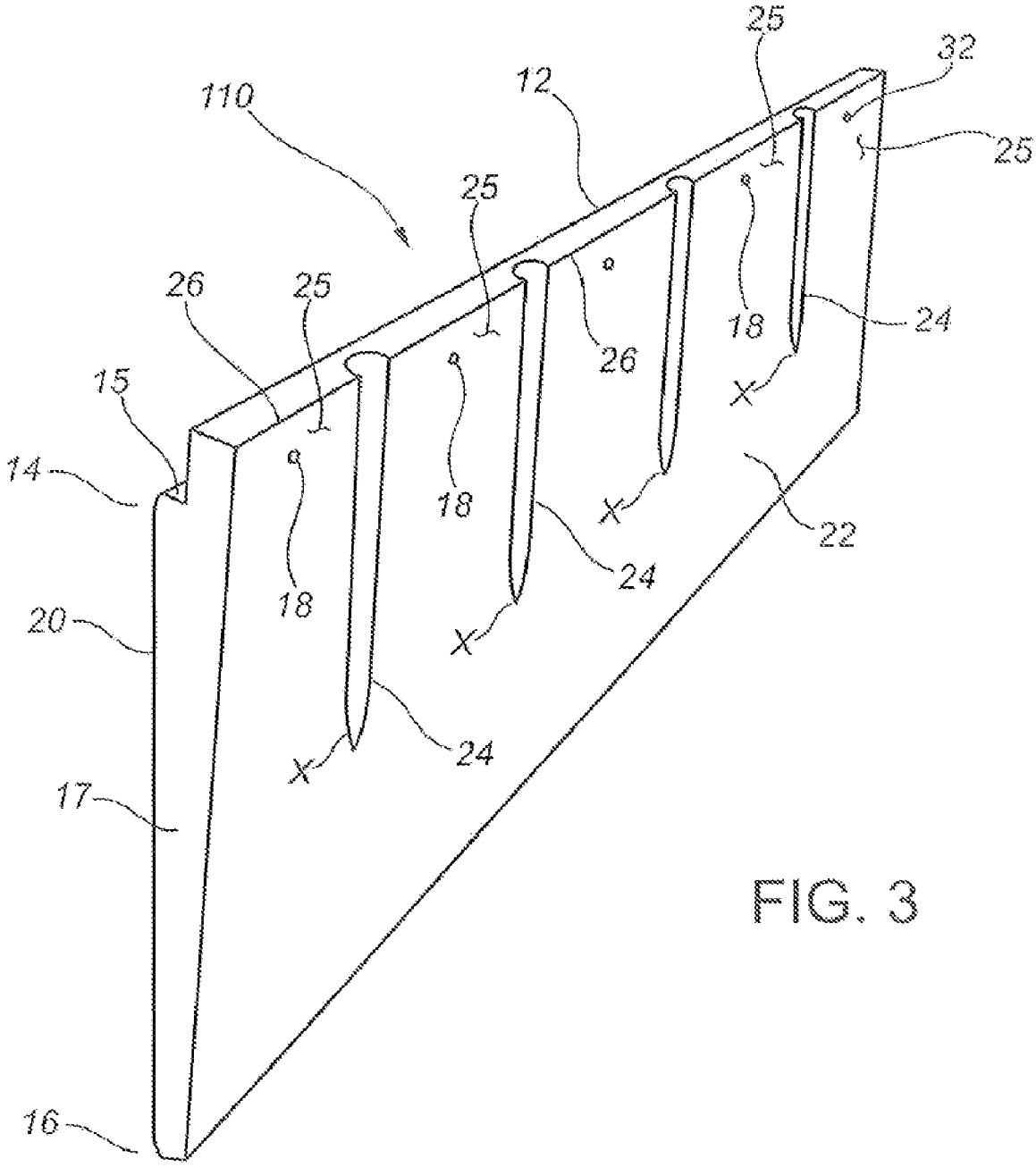
FIG. 3 is a perspective view of the rear face of a cladding panel in accordance with a second embodiment of the invention.

FIG. 3 illustrates a cladding panel 110 in accordance with an alternative embodiment of the invention, which can be mounted to a support structure 50 without the need for upper bumpers 30 but while still providing for a continuous airspace behind the mounted panel assembly. This is accomplished by forming generally vertical air channels 24 into the upper portion of rear face 22 of panel 110 (and at the same time forming abutment sections 25 between the air channels 24). The thickness of panel 110 tapers as previously described in connection with panel 10, and due to this taper, each air channel 24 intercepts rear face 22 at a point X above lower edge 16 of panel 110. Accordingly, panels 110 may be mounted to a support structure 50 in much the same fashion as described in connection with the embodiment shown in FIGS. 1 and 2, but with the top rear edges 26 of panels 110 bearing directly against the face of support structure 50. It will still be necessary or desirable in most cases to use lower spacer means when installing the lowermost course of panels 110 (to keep the front faces 20 of lower course panels 110 in desired alignment with upper panels 110), but otherwise the system is "bumperless", further reducing held labour and material costs. Despite the fact that each top rear edge 26 of each mounted panel 110 will be in contact with the face of support structure 50 along a corresponding line of contact, air channels 24 will ensure that air can circulate behind the mounted panel assembly.

Figure 4:
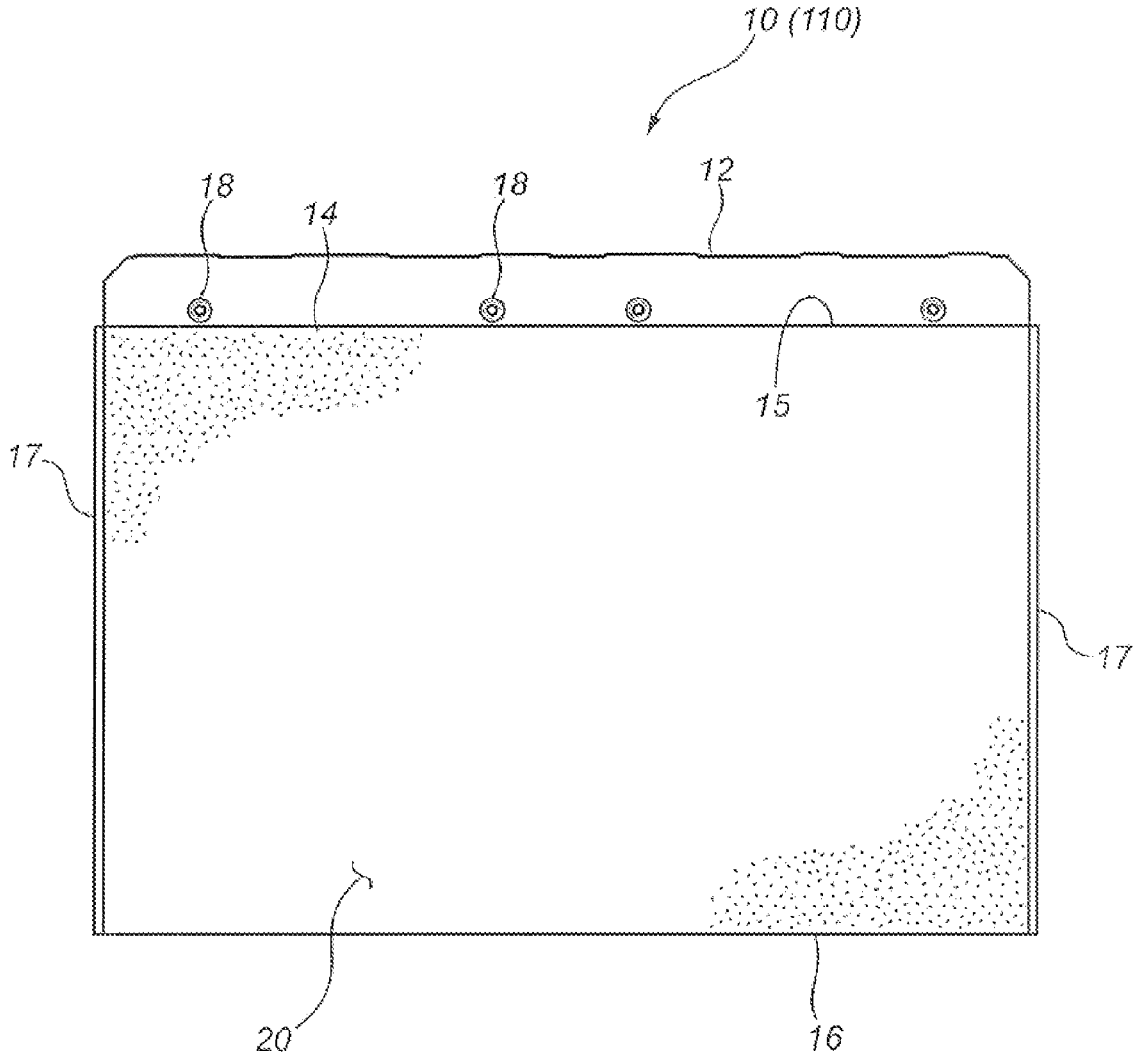
FIG. 4 is an elevation of the front face of a cladding panel in accordance with one embodiment of the present invention, illustrating a first exemplary fastener hole layout.
Figure 5:
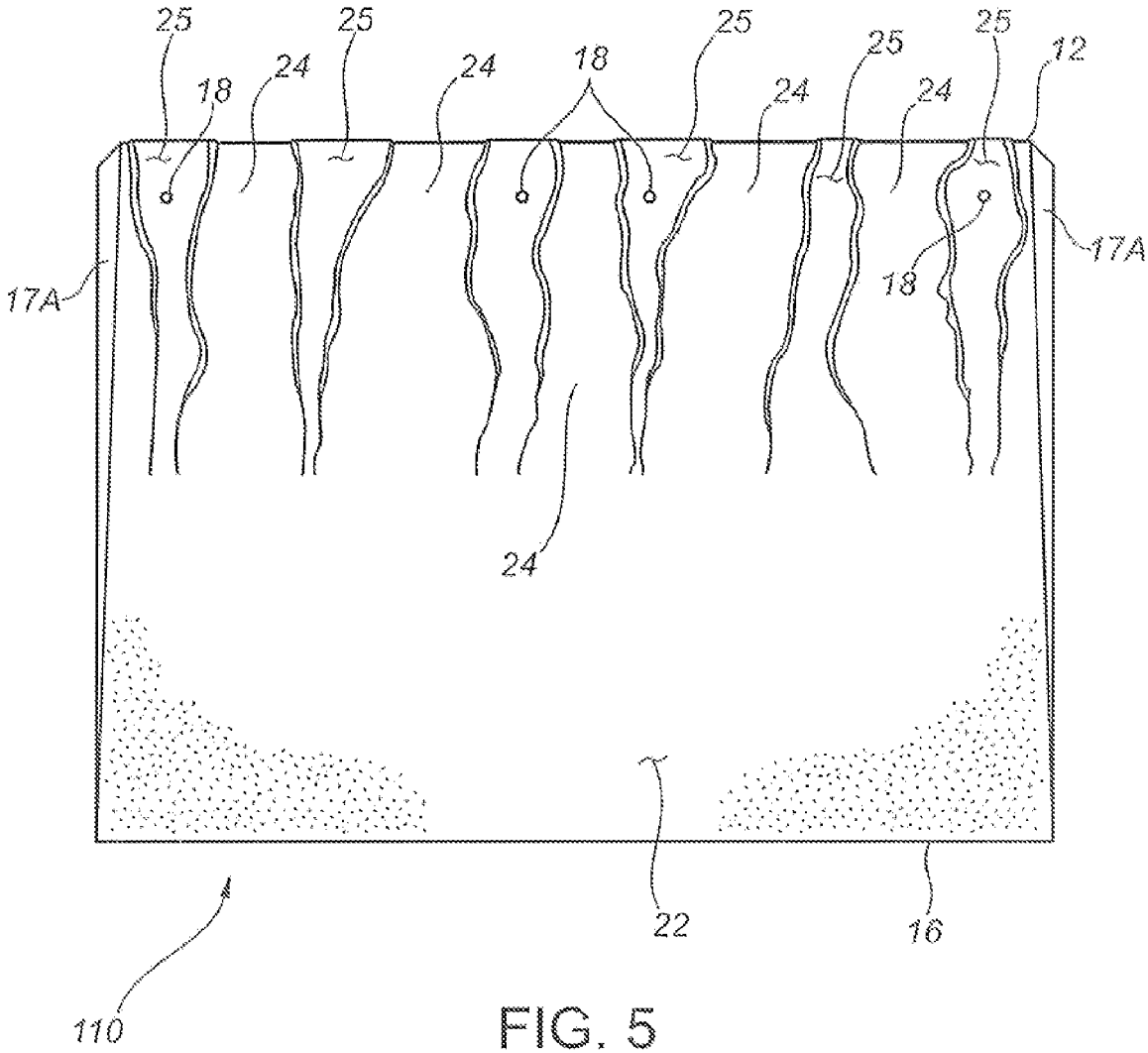
FIG. 5 is an elevation of the rear face of a cladding panel as in FIG. 4, having irregularly-formed abutment sections.

Persons skilled in the art will readily appreciate that numerous variants may be devised without departing from the basic concept of the invention. For example, while panel 110 shown in FIG. 3 has equally-spaced fastener holes 18, this is not essential; as indicated in FIGS. 4 and 5, the spacing of fastener holes 18 may be varied as necessary or desirable (subject to minimum structural requirements). FIG. 5 also illustrates that air channels 24 of "bumperless" embodiments do not have to be regularly-shaped (like the air channels 24 shown in FIG. 3). It has been found that forming air channels 24 in irregular patterns (such as shown in FIG. 5) can produce interesting visual effects on the front faces 20 of the panels, while not affecting the function of air channels 24.

Figures 6A, 6B, 6C, 6D, 6E, 6F:
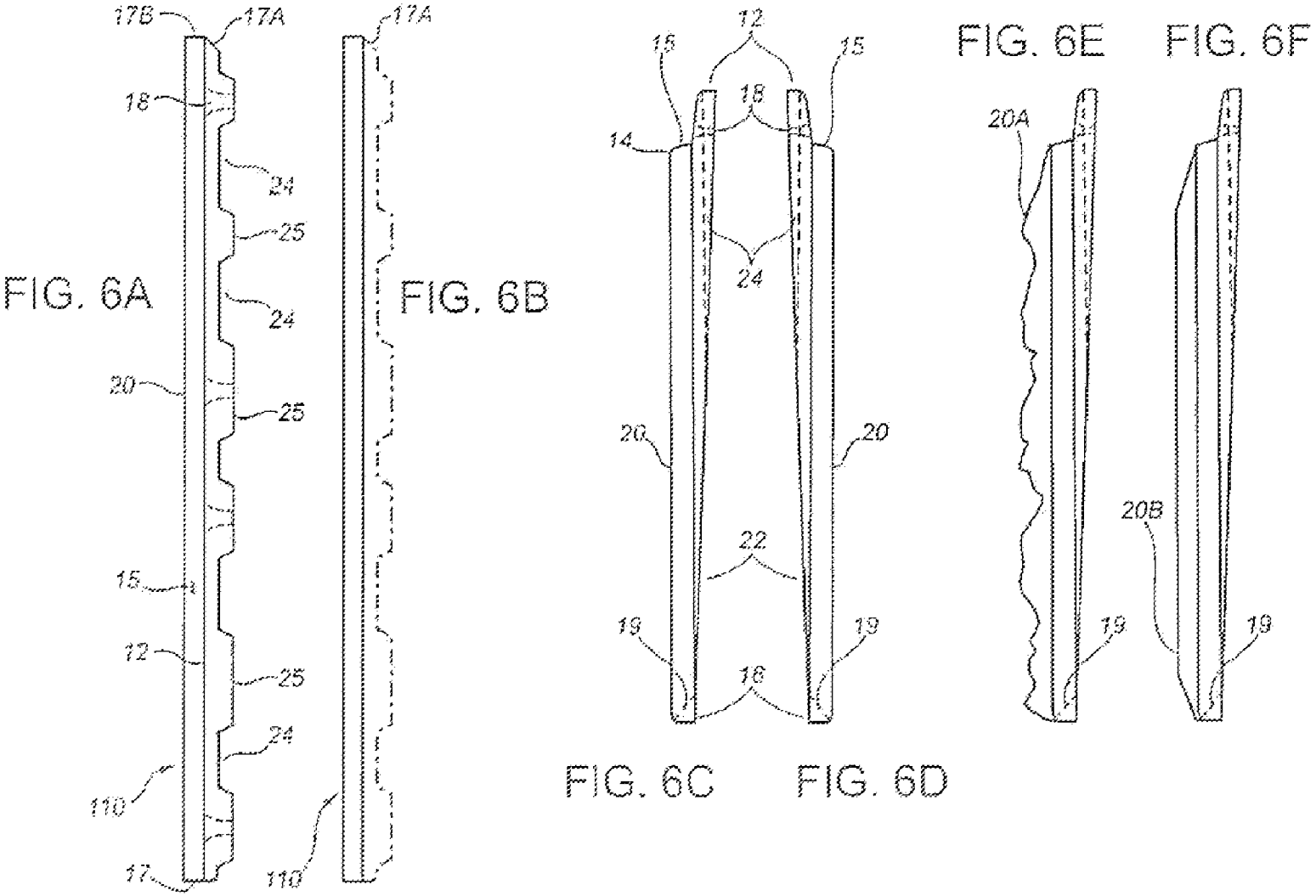
FIGS. 6A and 6B are top and bottom views, respectively, of a cladding panel in accordance with a preferred embodiment of the invention.
FIGS. 6C and 6D are side views of a cladding panel in accordance with the embodiments shown in FIGS. 6A and 6B.
FIGS. 6E and 6F are side views of alternative embodiments of cladding panels in accordance with the present invention, illustrating exemplary optional surface texturing on the front faces of the panels.

FIGS. 6A through 6F illustrates optional features and designs that may be applied to cladding panels in accordance with the present invention. FIGS. 6A and 6B are top and bottom views, respectively, of an alternative embodiment of "bumperless" panels 110, with air channels of trapezoidal cross-section. As shown, the rearward portion 17A of side edges 17 may have a 45-degree bevel to facilitate mounting the panels around building corners (i.e., forming what are known in the art as "quirk" joints). Although the side edge bevel is illustrated in the specific context of a "bumperless" panel, this feature would be optionally applicable to other panel embodiments as well.

FIGS. 6A and 6B also illustrate how the frontward portion 17B of side edges 17 may also be bevelled, for visual effect and also to facilitate panel forming and stripping. A 5-degree bevel is shown in FIGS. 6A and 6B for exemplary purposes. However, other bevel angles (and indeed other edge treatments) could be used without departing from the present invention; such bevelling or other edge treatments are not essential to the invention.

FIGS. 6C and 6D are side views of the panel shown in FIGS. 6A and 6B.

FIGS. 6E and 6F are side views of further alternative embodiments of the cladding panel of the present invention, having different front face profiles, FIG. 6E illustrates a panel with an irregular front face profile 20A (built out from the basic structural thickness of the panel), while FIG. 6F shows a panel with a built-out section 20B of more regular geometric configuration (which could be in the form of spaced vertical ribs or projecting panel sections, or any of many other conceivable designs). Front surface treatments such as illustrated in FIGS. 6E and 6F are purely aesthetic considerations, and are not in any way essential to the present invention.

Figure 7:
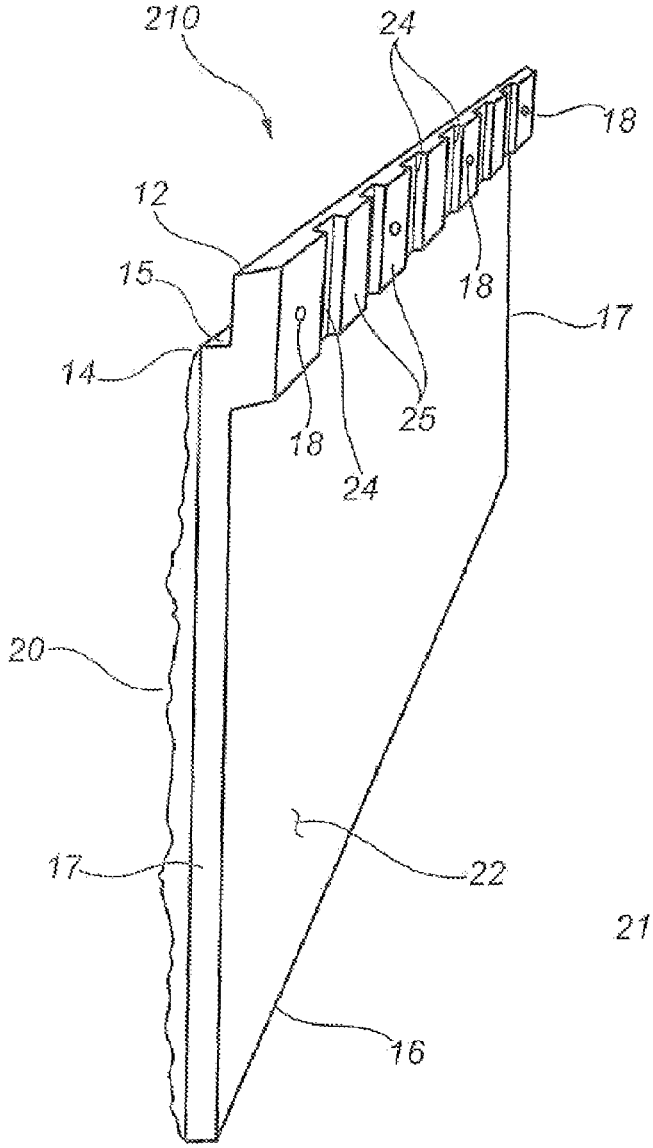
FIG. 7 is a perspective view of a cladding panel in accordance with a third embodiment of the invention.
Figure 8:
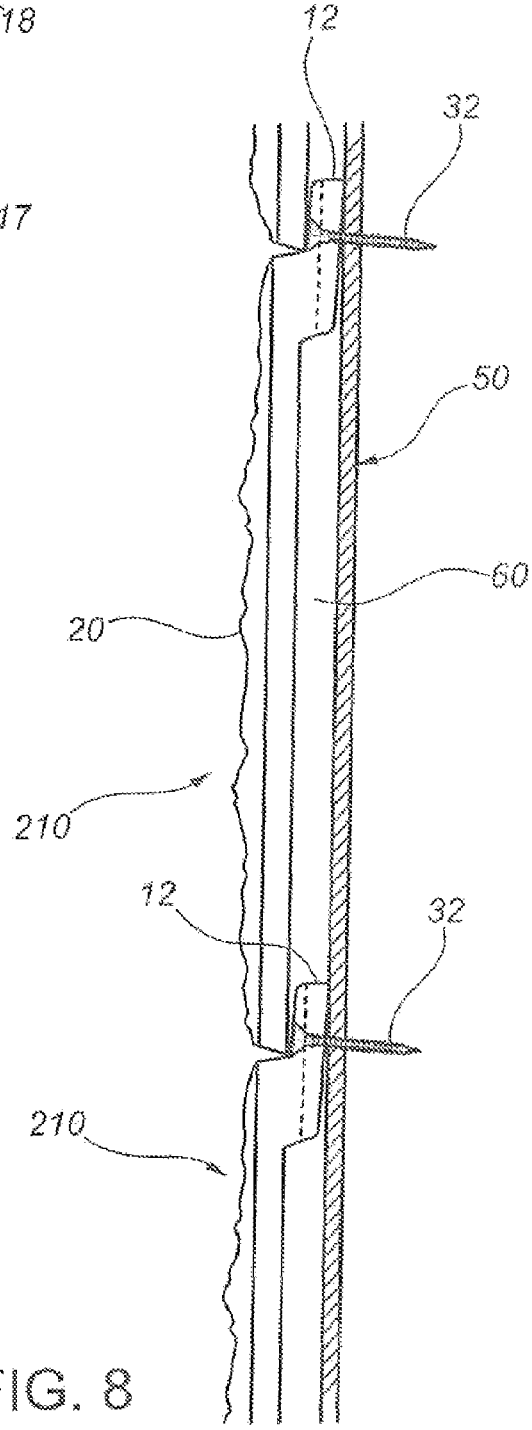
FIG. 8 is a cross-section through a typical horizontal joint between cladding panels in the assembly shown in FIG. 7.

FIGS. 7 and 8 illustrate a further embodiment 210 of a "bumperless" cladding panel in accordance with the invention. As shown, panel 210 is basically of constant thickness, rather than tapered. Spaced abutment sections 25 are formed along the upper portion of panel 210, projecting rearward from rear face 22, with air channels 24 being formed between abutment sections 25. Fastener holes 18 are located in some or all of the abutment sections 25, to facilitate mounting of panels 210 to a support structure 50 as shown in FIG. 8 and generally as previously described, using fasteners 32 driven through fastener holes 18 and into support structure 50. Abutment sections 25 are preferably formed with a slight taper on their rear faces, as may best be seen in FIG. 8. Due to this taper, the driving of fasteners 32 into support structure 50 will exert an additional moment that helps to hold lower edges 16 of panels 210 against the upstands 12 of the panels below. Desirable as this tape may be, though, it is not essential to the present invention, and the rear faces of abutment sections 25 of panel 210 may be unbeveled without departing from the scope of the invention.

Although the embodiment shown in FIGS. 7 and 8 is described herein as being "bumperless", it will be appreciated that lower spacer means will typically be required along the lower edges of the lowermost course of panels 210, in order to keep their front faces 20 in a desired alignment relative to other panels in the assembly.

It will be readily appreciated by those skilled in the art that various modifications of the present invention may be devised without departing from the essential concept of the invention, and all such modifications are intended to be included in the scope of the claims appended hereto. It is to be especially understood that the invention is not intended to be limited to illustrated embodiments, and that the substitution of a variant of a claimed element or feature, without any substantial resultant change in the working of the invention, will not constitute a departure from the scope of the invention.

In this patent document, the word "comprising" is used in its non-limiting sense to mean that items following that word are included, but items not specifically mentioned are not excluded. A reference to an element by the indefinite article "a" does not exclude the possibility that more than one of the element may be present, unless the context clearly requires that there be one and only one such element.

What is claimed is:

1. A precast panel having a front face, a rear face, an upper edge, and a lower edge, wherein:

(a) the upper edge or the panel has a continuous notch, forming:

a.1 a ledge extending rearward from the front face of the panel; and a.2 a substantially vertical upstand adjacent to the ledge and extending vertically upward from the level of the ledge to the upper edge of the panel, said upstand having a rear face and a top rear edge;

(b) a plurality of fastener holes extend through the thickness of the upstand;

(c) the thickness of the panel at its lower edge is less than or approximately equal to the transverse width of the ledge;

(d) the panel has one or more generally vertical channels formed in the rear face and extending downward from the top of the upstand; and (e) the rear face of the upstand is beveled such that when the panel is mounted to a supporting structure with the top rear edge of the panel's upstand bearing against a supporting structure along a line of contact, and with the front face of the panel substantially parallel to the supporting structure, a downwardly-opening, V-shaped gap will be formed between the rear face of the upstand and the supporting structure, with said V-shaped gap propagating downward from the line of contact between said top rear edge of the upstand and the supporting structure.

2. The precast panel of claim 1 wherein the ledge slopes transversely downward toward the front face of the panel.

3. The precast panel of claim 1, further having a plurality of notches at the lower edge of the rear face of the panel.

4. The precast panel of claim 1 wherein the rear face of the panel defines a substantially planar surface extending from the lower edge of said rear face of the panel to the top rear edge of the upstand, such that the rear face of the upstand is co-extensive with the rear face of the panel.

5. The precast panel of claim 1 wherein the one or more vertical channels are formed in irregular patterns.

6. The precast panel of claim 1 wherein:

(a) the panel's thickness is substantially constant between the panel's lower edge and a level at a selected distance below the ledge; and (b) the rear face of the upstand extends down to approximately the level of the upper limit of the substantially constant-thickness portion of the panel, such that the upstand protrudes rearwardly from the panel.

7. A panel assembly comprising a plurality of precast panels mounted in horizontal courses to a supporting structure, each panel having a front face, a rear face, an upper edge, and a lower edge, wherein:

(a) the upper edge of each panel has a continuous notch, forming:

a.1 a ledge extending rearward from the front face of the panel; and a.2 a substantially vertical upstand adjacent to the ledge and extending vertically upward from the level of the ledge to the upper edge of the panel, said upstand having a rear face and a top rear edge;

(b) a plurality of fastener holes extend through the thickness of the upstand of each panel;

(c) the thickness of each panel at its lower edge is less than or approximately equal to the transverse width of the ledge;

(d) each panel has one or more generally vertical channels formed in the rear face and extending downward from the top of the upstand;

(e) each panel is mounted to the supporting structure by means of fasteners passing through said fastener holes, such that the top rear edge of each panel's upstand bears against the supporting structure along a line of contact;

(f) the lower edge of each panel in all but the lowermost courses of the panel assembly is disposed within the notch of the below-adjacent panel or panels;

(g) the front faces of the panels in the panel assembly lie in substantially the same plane and are substantially parallel to the supporting structure; and (h) the rear face of the upstand of at least one of the panels is beveled such that a downwardly-opening, V-shaped gap is formed between the rear face of the upstand and the supporting structure, with said V-shaped gap propagating downward from the line of contact between said top rear edge of the upstand and the supporting structure.

8. The panel assembly of claim 7 wherein the ledge of at least one panel slopes transversely downward toward the front face of the panel.

9. The panel assembly of claim 7 wherein at least one panel has a plurality of notches at the lower edge of the rear face of the panel.

10. The panel assembly of claim 7 wherein the rear face of at least one panel defines a substantially planar surface extending from the lower edge of the rear face of said at least one panel to the top rear edge of the upstand of said at least one panel, such that the rear face of the upstand is co-extensive with the rear face of the panel.

11. The panel assembly of claim 7 wherein the one or more vertical channels are formed in irregular patterns.

12. The panel assembly of claim 7 wherein the thickness of at least one panel is substantially constant between the panel's lower edge and a level at a selected distance below the ledge, with the rear face of the upstand of said at least one panel extending down to approximately the level of the upper limit of the substantially constant-thickness portion of the panel, such that the upstand protrudes rearwardly from the panel.

13. A precast panel having a front face, a rear face, an upper edge, and a lower edge, wherein:

(a) the upper edge of the panel has a continuous notch, forming:

a.1 a ledge extending rearward from the front face of the panel; and a.2 a substantially vertical upstand adjacent to the ledge and extending vertically upward from the level of the ledge to the upper edge of the panel, said upstand having a rear face and a top rear edge;

(b) a plurality of fastener holes extend through the thickness of the upstand;

(c) the thickness of the panel at its lower edge is less than or approximately equal to the transverse width of the ledge;

(d) the panel has one or more generally vertical channels formed in the rear face and extending downward from the top of the upstand; and (e) the rear face of the upstand is tapered such that when the panel is mounted to a supporting structure with the top rear edge of the panel's upstand bearing against a supporting structure along a line of contact, and with the front face of the panel substantially parallel to the supporting structure, the only direct contact between the panel and the supporting structure will be along said line of contact between said top rear edge of the upstand and the supporting structure.

* * * * *